United States Patent [19]

Erickson, Jr.

[11] Patent Number: 4,735,555

[45] Date of Patent: Apr. 5, 1988

[54] AIR BLOWER ASSEMBLY FOR VACUUM CLEANER

[75] Inventor: Roy O. Erickson, Jr., Cadillac, Mich.

[73] Assignee: Rexair, Inc., Troy, Mich.

[21] Appl. No.: 782,510

[22] Filed: Oct. 1, 1985

[51] Int. Cl.[4] ..... F04B 35/04

[52] U.S. Cl. ..... 417/244; 417/423 A; 417/312

[58] Field of Search ..... 417/423 A, 312, 244

[56] References Cited

U.S. PATENT DOCUMENTS

| | | | |
|---|---|---|---|
| 1,320,224 | 10/1919 | Garmen | 417/312 |
| 1,927,947 | 9/1933 | Newell | 417/312 |
| 1,946,665 | 2/1934 | Bieth | 417/423 A |
| 2,030,366 | 2/1936 | Grave | 417/312 |
| 2,096,883 | 10/1937 | Clason | 417/423 A |
| 2,272,985 | 2/1942 | Smith | 417/423 A |
| 2,731,194 | 1/1956 | Kent | 417/312 |
| 3,366,316 | 1/1968 | Bayless | 417/423 A |
| 3,783,637 | 1/1974 | Woods | 62/427 |
| 4,330,899 | 5/1982 | Miller et al. | 15/326 |
| 4,435,877 | 3/1984 | Berfield | 15/326 |
| 4,462,137 | 7/1984 | Berfield et al. | 15/353 |

FOREIGN PATENT DOCUMENTS

| | | | |
|---|---|---|---|
| 652337 | 4/1951 | United Kingdom | 417/423 A |

OTHER PUBLICATIONS

Copy of portions of Rexair, Inc. Prior Art Vacuum Blower Unit Assembly taken from Drawing R-2000.

*Primary Examiner*—Carlton R. Croyle
*Assistant Examiner*—T. Olds
*Attorney, Agent, or Firm*—Harness, Dickey & Pierce

[57] ABSTRACT

An improved blower assembly particularly useful for liquid bath type vacuum cleaners is disclosed. The improved blower assembly features enhanced noise attenuation achieved by providing a four-stage noise reduction system featuring a serpentine airflow path at the blower assembly air inlet and outlet. The four stages of the noise reduction system are comprised of; a noise reduction stage housing, a lower stage assembly, an upper stage assembly, and a motor base, respectively. Improvements in the production assembly techniques of the blower assembly components are further provided through a modified upper stage assembly which is assembled to a motor base component by a partial turn and lock procedure so that the components become firmly locked together and accurately positioned. This production technique can be accomplished quickly without a requirement of a high degree of operator skill.

10 Claims, 5 Drawing Sheets

AIR BLOWER ASSEMBLY FOR VACUUM CLEANER

BACKGROUND AND SUMMARY OF THE INVENTION

This invention relates to vacuum cleaning devices and particularly to an improved air blower assembly for use in conjunction with liquid bath type vacuum cleaners.

Vacuum cleaners of various designs are used in residential and commercial settings for cleaning purposes. These appliances develop suction to create airflow which picks up particulates from the surface being cleaned. These particulates are separated from the air within the vacuum cleaner for later disposal. One type of vacuum cleaner is a so-called canister type which has a relatively stationary canister which is connected to a movable nozzle or wand by a flexible connecting hose. One design of canister type vacuum cleaners known as a liquid bath type directs incoming air and particulates into contact with a liquid bath which absorbs the particulate matter. Liquid bath vacuum cleaners have the significant advantage that their filtration mechanism uses readily available water, thereby eliminating the need for replaceable filters. These machines further provide a room humidifying effect since some water becomes dissolved in the air discharged from the vacuum cleaner during use.

Numerous designs of liquid bath type vacuum cleaners are presently known. For example, U.S. Pat. Nos. 2,102,353, 2,221,572, 2,886,127 and 2,945,553, all of which are assigned to the assignee of this invention, are related to various improvements in liquid bath type vacuum cleaners. Although devices constructed in accordance with the above-mentioned issued patents perform satisfactorily, designers are constantly seeking to reduce the noise level created by operation of vacuum cleaners. In order to provide a vacuum cleaner having satisfactory performance, high-powered air blowers are used to create the desired level of suction pressure with sufficient air flow rate capability necessary to remove entrapped, heavy, or minute particles. Such blower assemblies utilize rapidly rotating fan assemblies which generate noise which can constitute an annoyance to the user or others nearby. It has been found that high frequency noise is particularly undesirable. Designers of canister type vacuum cleaners are further continually attempting to improve the assembly techniques used in manufacturing these devices so that they can be produced at lower costs and with high precision. Present techniques employed to assemble the various elements making up the vacuum cleaner blower assembly lead to high labor costs since various components must be properly positioned, measured and adjusted in order to provide the necessary precision.

In view of the foregoing, it is an object of this invention to provide an improved blower assembly for vacuum cleaners. It is a further object of this invention to provide a blower assembly for a vacuum cleaner having improved sound attenuation features. It is yet another object of this invention to provide an improved blower assembly for vacuum cleaners which can be assembled quickly and accurately without requiring a high degree of operator skill and direct labor during production.

The above objects of this invention are provided by employing a series of fixed air flow directing vanes and barriers at the blower assembly inlet and outlet which serve to suppress the noise level generated by the internally rotating blower components. In part, such noise attenuation is achieved by directing the air to flow along a serpentine route at both the air inlet and outlet to prevent a straight uninterrupted path for the conduction of sonic waves. Improvement in the production assembly techniques are achieved by providing an improved upper stage assembly which features partial turn locking engagement with the motor base component which can be accomplished quickly yet provides a high degree of dimensional precision.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
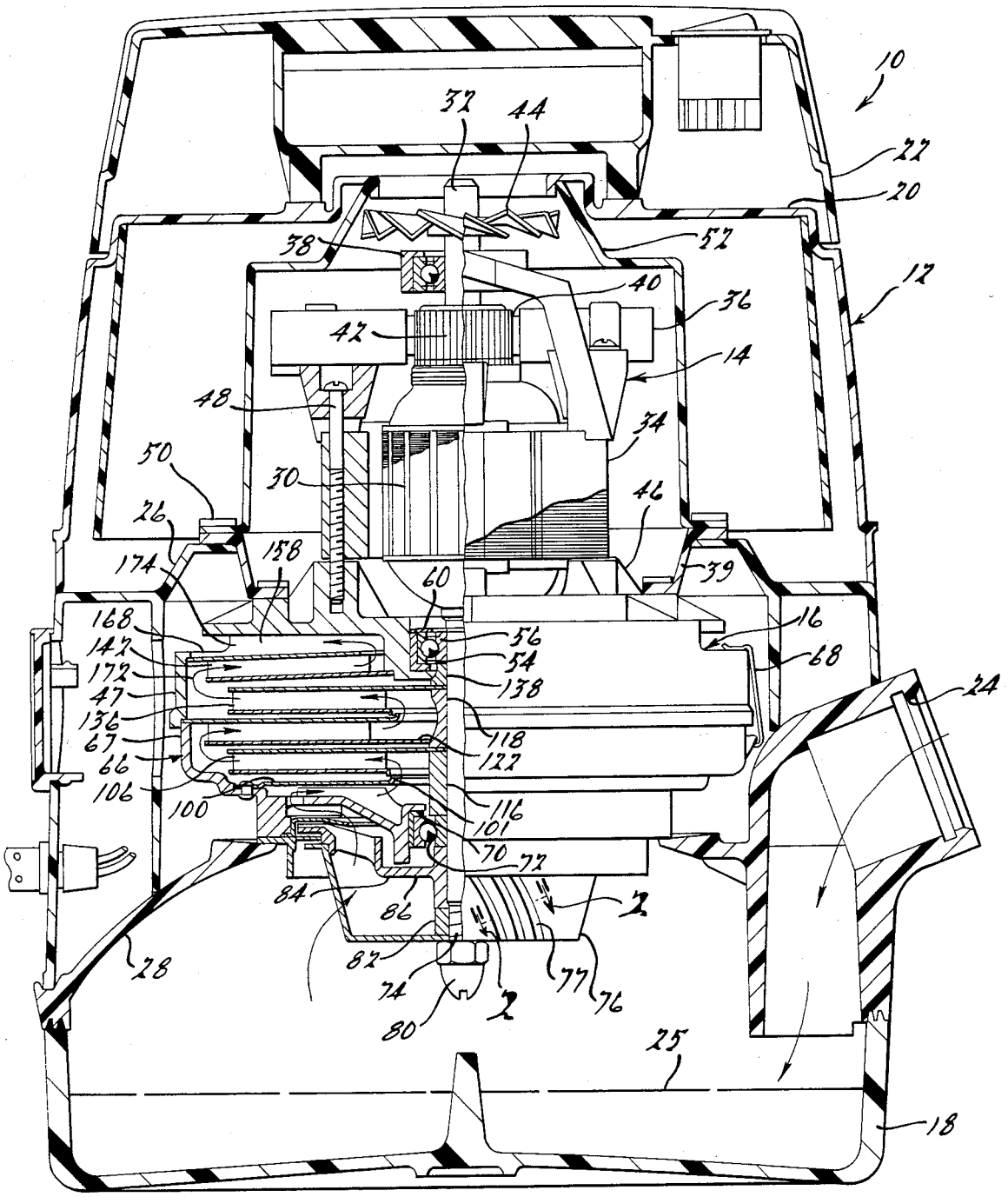
FIG. 1 is a partial longitudinal cross-sectional view and partial side elevational view of internal components of a vacuum cleaner including an improved blower assembly in accordance with this invention particularly showing the construction details of the vacuum cleaner housing assembly, motor assembly, and blower assembly.
Figure 4:
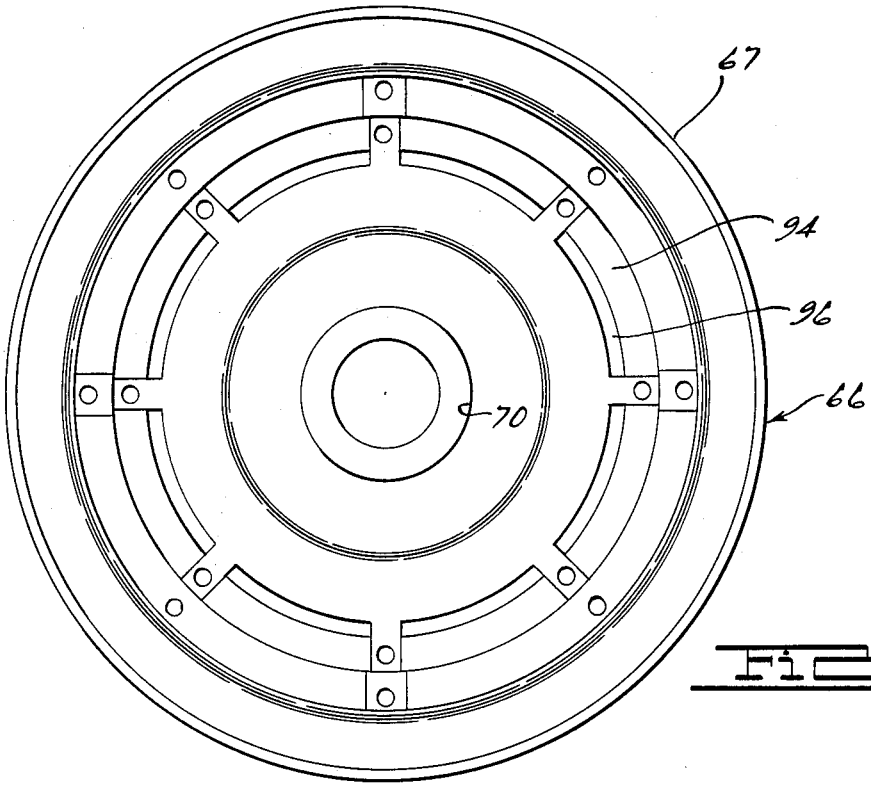
FIG. 4 is a top elevational view of the noise reduction stage housing of the blower assembly.

A vacuum cleaner 10, including the improvements according to this invention, is shown assembled in FIG. 1 and principally comprises a housing assembly 12, a motor assembly 14, and a blower assembly 16.

The housing assembly 12 includes a lower water pan 18, a cap 20 and a cap cover 22. Preferably, the cap 20 is easily removable from the water pan 18 enabling convenient removal and replacement of liquid therein. The motor assembly 14 and the blower assembly 16 are generally centrally supported within the housing assembly 12. The motor assembly 14 and the blower assembly 16 are positioned within the housing assembly 12 by providing a pair of ring-shaped support members 26 and 28. In operation, air is drawn through an inlet 24 into the water pan 18 where the air stream impinges against a water or liquid bath 25 which serves to absorb particulates entrained in the inlet air. Air flow through vacuum cleaner 10 is generated through suction developed by the blower assembly 16, which draws air from the upper portion of the chamber formed by the water pan 18. More specific details of operation of liquid bath type vacuum cleaners are provided by the previously identified issued U.S. patents.

The motor assembly 14 provides motive power for operation of the blower assembly 16. The motor assembly 14 includes a central rotating armature 30 encircling and connected to a motor shaft 32, which extends downwardly into the blower assembly 16. Surrounding the armature assembly 30 is a field assembly 34. A combination bearing retainer and brush holder 36 is provided which retains an upper bearing assembly 38 and supports a pair of brushes 40 which communicate electrical energy to the armature 30 through a commutator 42. The motor assembly 14 is of the type generally known as a universal motor, which has the desirable operating characteristics for use in conjunction with vacuum cleaning devices. An axial flow motor fan 44 is attached to the upper portion of the motor shaft 32 and generates air flow for cooling of the motor assembly 14. The field assembly 34 and the bearing retainer and brush holder 36 are fixed through attachment to a motor base 46 by using threaded fasteners 48. The motor base 46 is in turn connected to a web 39 by employing a clamping ring 50. The direction of air flow past the motor assembly 14, generated by the fan 44, is controlled by providing a baffle 52 which generally encircles and encloses the motor assembly. The motor base 46 further defines a bearing retainer pocket 54 which receives a middle bearing assembly 56 which is secured by a push-in type clip 60.

Figure 2:
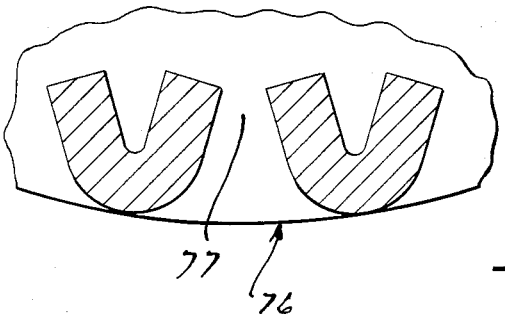
FIG. 2 is a cross-sectional view taken along line 2—2 of FIG. 1 showing particularly the configuration of the separator component slots.

Now with specific reference to FIG. 1 and the detailed views provided by FIGS. 2 through 10, the significant details and features of the blower assembly 16 of this invention will be described. The blower assembly 16 defines an enclosed housing formed by the annular outer ring portion 47 of the motor base 46, and the housing portion 67 defined by the noise reduction stage housing 66. As shown in FIG. 1, the motor base 46 and the noise reduction stage housing 66 components are connected together by providing several housing clips 68. The noise reduction stage housing 66 further defines a lower bearing retaining pocket 70 which acts to position a lower bearing assembly 72. Within the interior of the blower assembly 16 are a number of rotating and fixed airflow driving and directing components. The motor shaft 32 extends into the blower assembly 16 and defines a lower threaded end 74. A separator 76 is provided having a cup-like form with a plurality of slots therein as best shown in FIG. 2. The separator 76 rotates with the motor shaft 32 and is fixed thereto through clamping between acorn-style nut 80 and a lock nut 82 which are both threaded onto the motor shaft threaded end 74.

Figure 3:
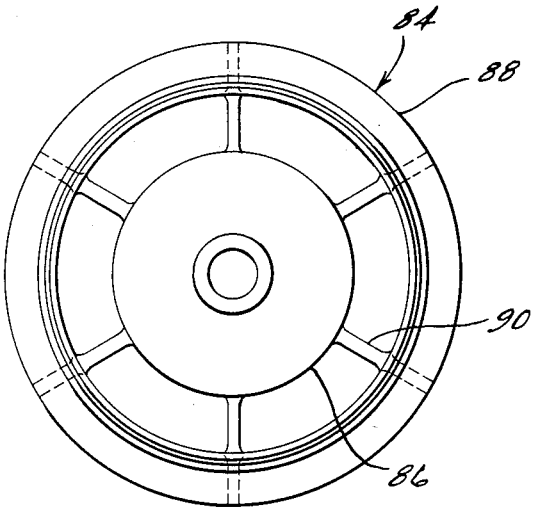
FIG. 3 is a bottom elevational view of the spider component of the blower assembly.

The blower assembly 16 further includes a spider component 84 which is best shown in FIG. 3. The spider 84 rotates with the motor shaft 32 and includes a central cup portion 86 which generally surrounds the lower bearing assembly 72. The spider 84 further includes an outer ring portion 88 with a plurality of radially extending webs 90 which bridge between the cup portion 86 and the outer ring portion 88.

Figure 5:
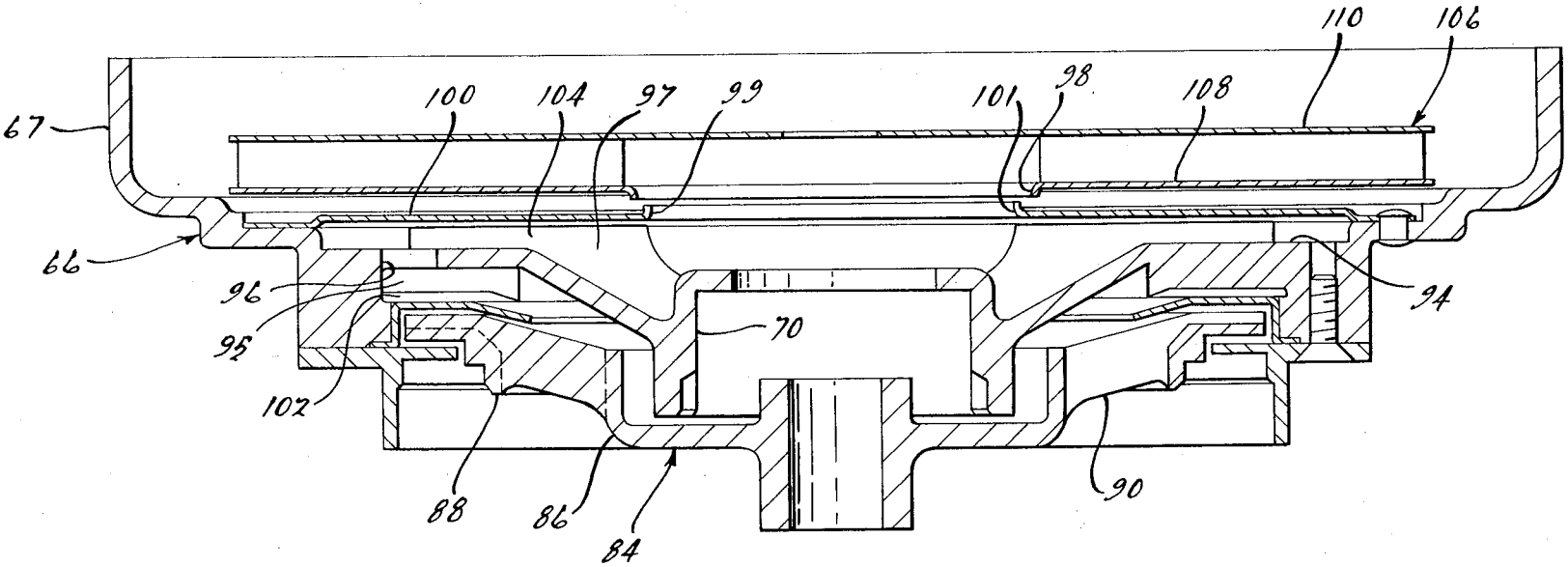
FIG. 5 is a cross-sectional view taken along line 5—5 of FIG. 1 showing in detail the configuration of the separator, spider, and noise reduction stage housing of the blower assembly and further showing the path of air flow through these components.

The noise reduction stage housing 66 is the first of four stages which combine to attenuate sound generated by the internal moving components of the blower assembly 16. The details of construction of the noise reduction stage housing 66 are best explained with reference to FIGS. 4 and 5. Extending radially between the bearing retainer pocket 70 and the housing portion 67 is a plate 94 which defines a narrow airflow gap 96. Plate 94 includes vanes 95 and 97 on both faces of the plate 94 for directing suction air to and from gap 96. A baffle plate 100 is fastened to the noise reduction stage housing 66 and has a central hole 101 with a radiused inner edge 99. The assembly of the spider 84, the noise reduction stage housing 66 and the baffle plate 100 is shown in FIG. 5. As shown by that Figure, these elements define a pair of air chambers 102 and 104 which are separated by the plate 94 but which communicate by gap 96.

Figure 6:
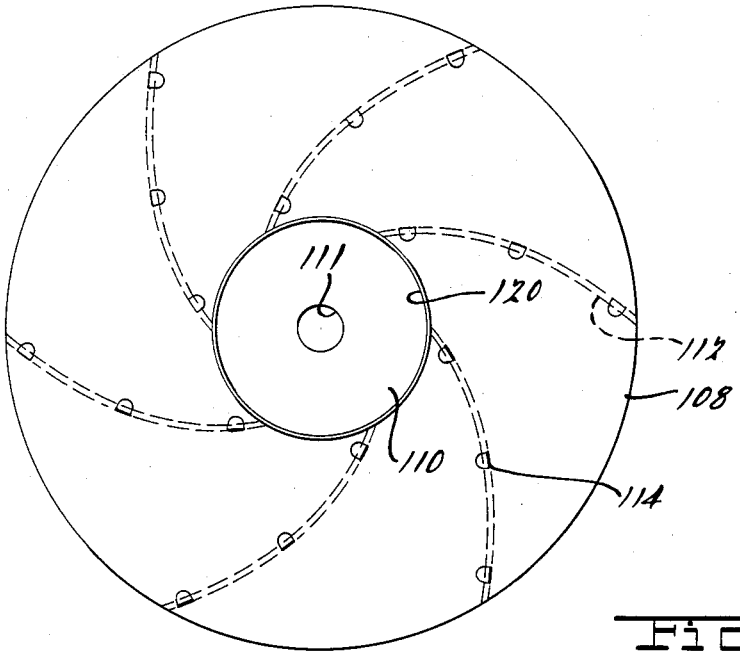
FIG. 6 is a bottom elevational view of one of the fan assemblies of the blower assembly.

The lower fan assembly 106 is best shown in FIGS. 5 and 6 and rotates with the motor shaft 32. As shown in FIG. 6, the fan assembly 106 is formed by assembling a pair of disc-shaped parallel plates, a fan plate 108 and a fan back 110, with a plurality of radially extending and swept blades 112 therebetween. The fan plate 108 has an enlarged central hole 120 and the fan back 110 has a smaller central hole 111. The blades 112 are preferably fixed to the fan plate 108 and the fan back 110 by providing a plurality of axially extending deformable tabs 114 which fit through corresponding slots in the plate surfaces and are thereafter deformed to interlockingly engage the components. The fan assembly 106 is fixed for rotation with the motor shaft 32 through clamping between a pair of shaft spacers 116 and 118. The fan assembly 106 is positioned in the blower assembly 16 so that the fan plate 108 is positioned beneath the fan back 110. The inner radial edge 98 of the fan plate 108 is slightly deformed to define a radius to smoothen the airflow path into the lower fan assembly 108.

Figure 7:
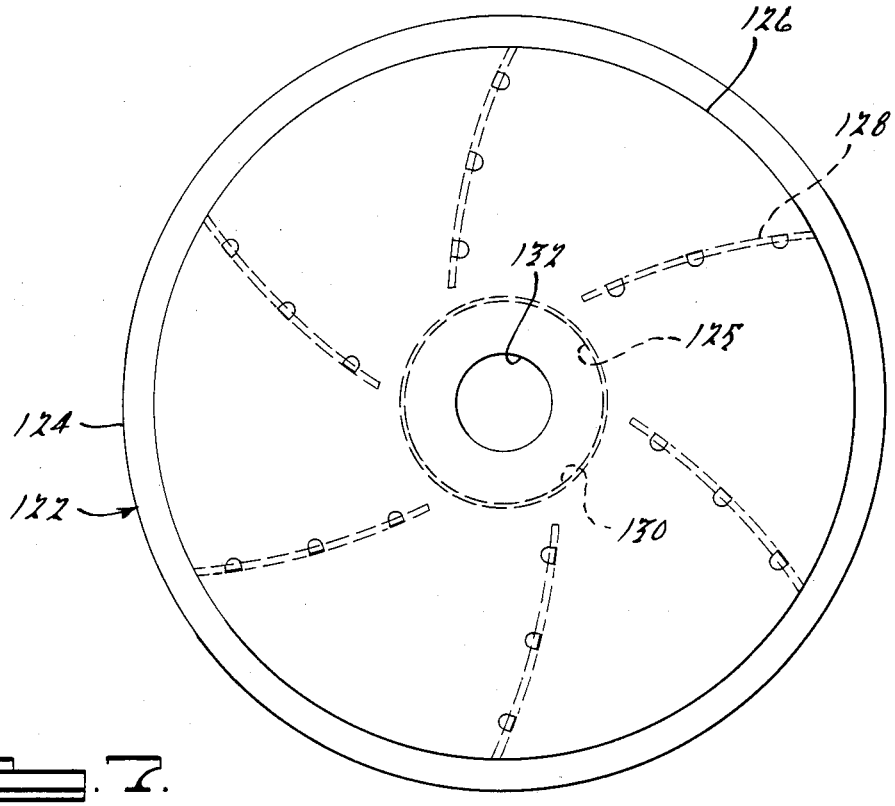
FIG. 7 is a bottom elevational view of the lower stage assembly of the blower assembly.
Figure 9:
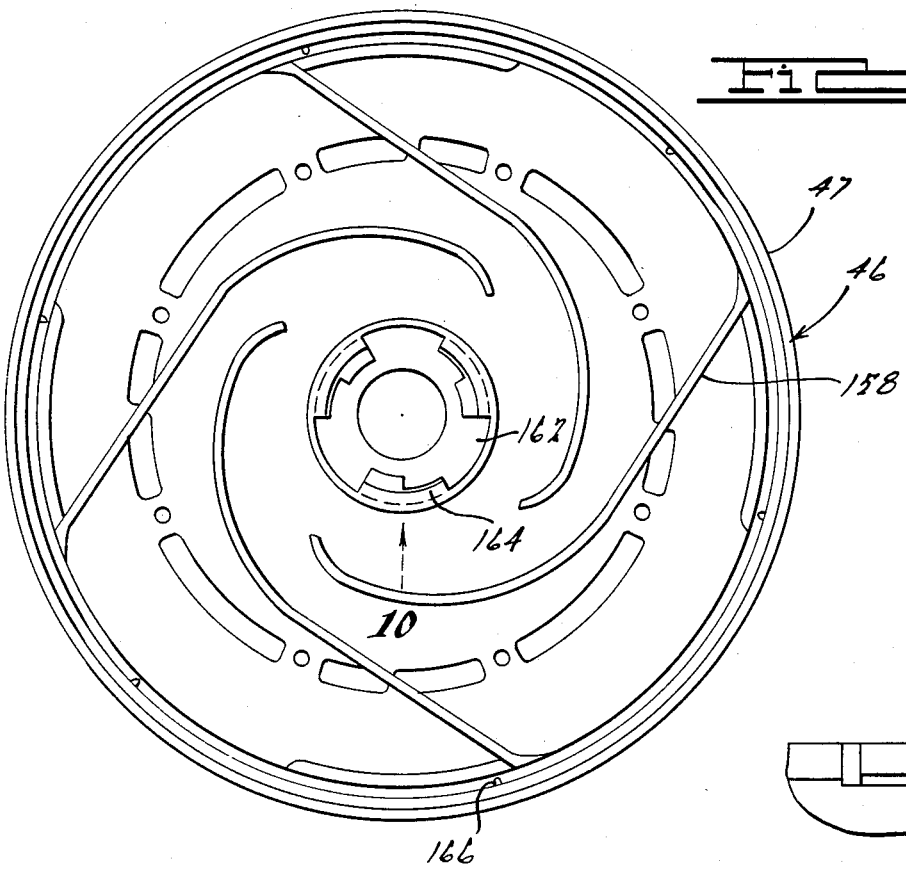
FIG. 9 is a bottom elevational view of the motor base of the blower assembly.
Figure 10:
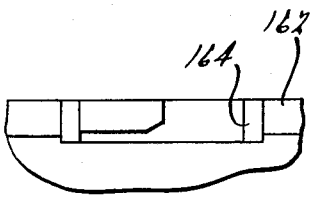
FIG. 10 is a partial elevational view taken in the direction of arrow 10 particularly showing the locking pocket of the motor base.

The lower stage assembly 122 constitutes a second stage which contributes to noise attenuation and is best described with reference to FIG. 7. The lower stage assembly 122 is assembled by attaching a stage back 124 and a stage plate 126 to a plurality of vanes 128. As described previously in connection with the fan assembly 106, a plurality of tabs are preferably provided which protrude from the blades 128 which permit interlocking attachment with the stage back 124 and the stage plate 126. The stage back 124 has an outer diameter which is greater than that of the stage plate 126. The lower stage assembly 122 is held in a fixed position within the blower assembly 16 by being clamped between outer ring portion 47 of the motor base 46 and the housing portion 67 of the noise reduction stage housing 66. The stage back 124 defines an enlarged circular air flow hole 130 with a radius inner edge 125 whereas the stage plate 126 defines a reduced diameter central hole 132 which provides only slight clearance with the shaft spacer 116.

Positioned immediately above the lower stage assembly 122 is another fan assembly 136 which is substantially identical with the fan assembly 106. The fan assembly 136 also rotates with the motor shaft 32 and is clamped between the motor shaft spacer 116 and another shaft spacer 138.

Figure 8:
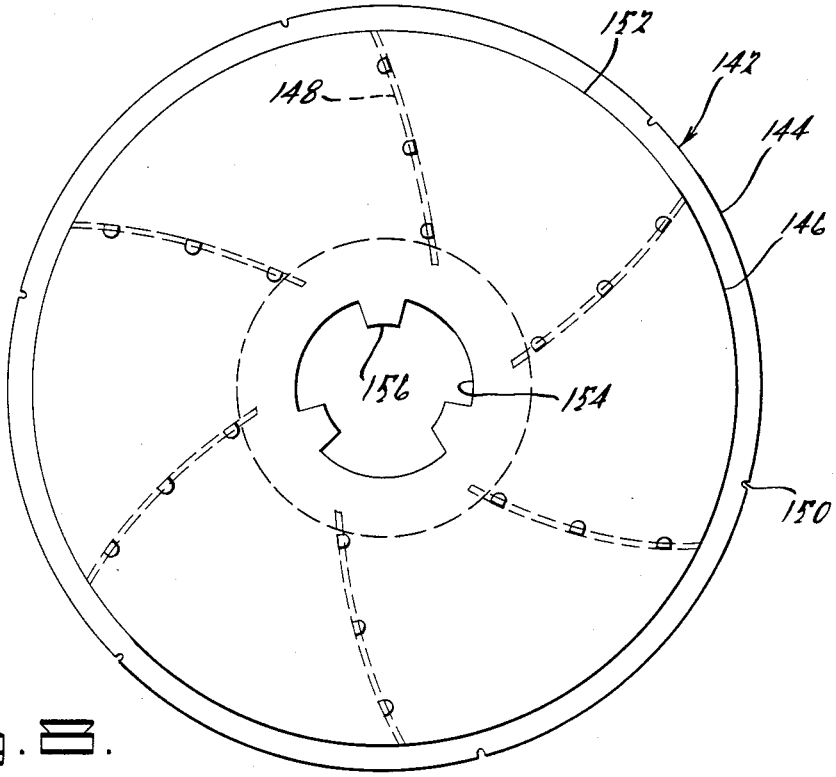
FIG. 8 is a bottom elevational view of the upper stage assembly of the blower assembly.

The upper stage assembly 142 is a third stage contributing to noise attenuation and is best described with reference to FIG. 8. The upper stage assembly 142 includes a stage back 144, a stage plate 146, and a plurality of vanes 148. Like the fan assemblies 106 and 136 and the lower stage assembly 122, the components are interlockingly connecting by deformable tabs. The diameter of the stage back 144 is greater than that of the stage plate 146 and includes a plurality of circumferentially spaced notches 150 in the outer periphery thereof. The stage back 144 defines an enlarged central air flow hole 152. The stage plate 146 defines a central hole 154 having an irregular perimeter shape defined by an outer circle with one or more inwardly projecting tabs 156.

The motor base 66 constitutes a fourth and final stage contributing to the noise attenuation feature provided by vacuum cleaner 10. The configuration of the motor base 66 is best described with reference to FIGS. 9 and 10. The lower surface of the motor base 66 defines a plurality of extending baffles 158 and an air flow exit gap 168. The central portion of the motor base 66 having the middle bearing pocket 54 has a spool-shaped lower portion 162 with one or more pockets 164, best shown in FIG. 10. The pockets 164 are formed having an "L"-shaped configuration so that the upper stage assembly 142 may be loaded onto the lower portion 162 by relative axial movement and thereafter becomes axially restrained therewith by partial rotation once the tabs 156 have reached the bottom surface of the pockets 164. The motor base outer ring portion 47 further defines a plurality of radially inwardly projecting lugs 166 which extend in a longitudinal direction and are spaced about the periphery of the motor base so that they will be received by the notches 150 of the upper stage back 144 once the upper stage assembly 142 has been rotated to its assembled position. This interlocking engagement permits the upper stage assembly 142 to be quickly loaded onto the spool 162 and rotated to an assembled position wherein the parts become locked together, thereby quickly assembling and accurately locating the upper stage assembly 142 into position relative to the motor base 66. Preferably, when the upper stage assembly 142 is in its final assembled position, it is slightly axially deformed such that the upper stage back 144 is biased into engagement with lugs 166. The upper stage assembly 142 and the motor base 66 combine to define a pair of air chamber 172 and 174 separated by the flow path of air through the upper stage assembly 142.

The operation of the blower assembly 16 will now be described in detail with particular reference to FIGS. 1 and 5. Air is drawn by the blower assembly 16 through the separator 76 which acts to remove water droplets entrained in the air by centrifugal water separation action, since the separator rapidly rotates with the motor shaft 32. Airflow directly to blower assembly 16 around the outside of the spider 84 is prohibited by providing small vanes or surface features on the top surface of the spider which tends to generate a secondary airflow of low rate from the chamber 102 into the volume defined by the water pan 18. This secondary "counterflow" air current prevents air from bypassing the separator 76. The primary air flow enters within the interior of the separator 76 by passing through the slots 77. As is best shown in FIG. 5 and indicated by arrows showing the direction of air flow, the air flow is then caused to undergo a serpentine flow path into the blower assembly 16; first, through gaps of the spider 84, and then into the air chamber 102, through the noise reduction stage housing 66, and into the air chamber 104. This flow path into the intake of the blower assembly 16 comprises a first stage in the noise reduction system provided by the blower assembly. The serpentine route of the air which separates the air chambers 102 and 104 cause a marked attenuation in the sound emitted through the intake of the blower caused by the internally rotating fan assemblies 106 and 136 and particularly reduces high frequency noise.

After the air passes through the noise reduction stage housing 66, it passes through the hole 101 of the baffle plate 100 and enters into the center portion of the fan assembly 106 through hole 120. Flow resistance and noise generated within this portion of the flow path are reduced by the presence of radiused edges 98 and 99. The air is thereafter forced radially outward by centrifugal action due to the rapid rotation of the fan assembly 106. The air then travels from a radially outer position inwardly through the lower stage assembly 122 which constitutes the second noise reduction stage by passing through the gap created between the stage plate 126 and the stage back 124 and exits through enlarged hole 130. The air is thereafter again subjected to the pumping effect of the fan assembly 136 and is directed in a radially inward direction by the upper stage assembly 142 in a fashion similar to that provided by the lower stage assembly 122. Radiused radially inner edges are also provided on both lower stage assembly 122 and the fan assembly 136 to smoothen airflow. The upper stage assembly 142 comprises a third stage in the noise reduction system provided by vacuum cleaner 10. When the air exits from the hole 152, it is directed against the vanes 158 of the motor base 46 which is the final stage providing a noise attenuation effect. This effect is produced by causing the air to undergo a serpentine airflow path as it exits the blower assembly 16 first from the air chamber 172, radially inwardly through upper stage assembly 122, axially and then radially outwardly through the motor base 46 to the air chamber 174. Like the noise reduction provided at the inlet of the blower assembly, the serpentine airflow route between the chambers 172 and 174 particularly reduces annoying high frequency noise emissions.

While the above description constitutes the preferred embodiments of the present invention, it will be appreciated that the invention is susceptible to modification, variation and change without departing from the proper scope and fair meaning of the accompanying claims.

What is claimed is:

1. A blower assembly for a vacuum cleaner adapted to be driven by a motor, said motor surrounded by a housing, said blower assembly comprising:

a noise reduction stage housing defining a serpentine flow path for air entering said blower assembly, baffle means positioned within and secured to said noise reduction stage housing for reducing noise of suction air entering said stage housing and enabling the air to pass into said stage housing, first and second fan assemblies rotatably driven by said motor for drawing air through said blower assembly, a fixed lower stage assembly positioned between said first and said second fan assemblies for directing air from said first to said second fan assembly, a fixed upper stage assembly for directing air discharged from said second fan assembly to a central airflow hole, and a motor base separating said motor housing from said noise reduction stage housing and having airflow directing vanes which receives air passing through said fixed upper stage assembly central airflow hole, said motor base air flow vanes extending to the center of said motor base and directing air flow from the center radially out of said noise reduction stage housing preventing said air flow from entering into said motor housing and said motor base and said noise reduction stage housing each acting to attenuate noise generated by the rotation of said first and second fan assemblies.

2. The blower assembly for a vacuum cleaner according to claim 1 wherein said noise reduction stage housing and said motor base define shell portions of a housing which encloses said first and second fan assemblies and said lower and upper stage assemblies.

3. The blower assembly for a vacuum cleaner according to claim 1 wherein said noise reduction stage housing causes said air to first flow in a radially outwardly direction, then axially, and then radially inwardly.

4. The blower assembly for a vacuum cleaner according to claim 1 wherein said noise reduction stage housing further defines a plate forming a radially outer gap.

5. The blower assembly for a vacuum cleaner according to claim 4 wherein said noise reduction stage housing defines vanes on both faces of said plate.

6. The blower assembly for a vacuum cleaner according to claim 1 wherein said motor base defines a plurality of radially extending airflow directing vanes.

7. A blower assembly for a vacuum cleaner adapted to be driven by a motor, said motor surrounded by a housing, said blower comprising:

a noise reduction stage housing having a plate surface defining a serpentine path for air entering said blower assembly, said noise reduction stage housing having a central plate which causes air to flow in a radially outward direction along one face of said plate axially past the outer edge of said plate and radially inward along the opposite face of said plate, a baffle positioned above said central plate and fastened to said reduction stage housing for reducing noise of suction air entering into said stage housing, said baffle having a central hole for enabling air to pass into said stage housing, a first fan assembly rotatably driven by said motor, said first fan assembly having a fan plate and a fan back with a plurality of blades therebetween, said fan plate having an enlarged central hole for receiving air from said noise reduction stage, said first fan assembly discharging air from its radially outer edge, a lower stage assembly fixed with respect to said noise reduction stage housing, said lower stage assembly having a stage plate and a stage back with a plurality of vanes therebetween, said stage back having an enlarged central hole, said air flowing from said first fan assembly radially inward and discharging through said central hole, a second fan assembly rotatable with said motor, said second fan assembly having a fan plate and a fan back with a plurality of blades therebetween, sad fan plate having an enlarged central hole for receiving air from said lower stage assembly, said second fan assembly discharging air from its radially outer edge, an upper stage assembly fixed with respect to said noise reduction stage housing, said upper stage assembly having a stage plate and a stage back with a plurality of vanes therebetween, said stage back having an enlarged central hole, said air flowing from said second fan assembly radially inward and discharging through said central hole, and a motor base separating said motor housing from said noise reduction stage housing and having a plurality of vanes for directing airflow from said upper stage assembly central hole, said vanes extending to the center of said motor base and directing air flow from the center radially out of said noise reduction stage housing preventing said air flow from entering into said motor housing acting to attenuate noise generated by the rotation of said first and second fan assemblies.

8. The blower assembly for a vacuum cleaner according to claim 7 wherein said motor base and said noise reduction stage housing have shell portions defining a housing which encloses said blower assembly.

9. The blower assembly for a vacuum cleaner according to claim 8 wherein said shell portions clamp said lower stage assembly stage back thereby positioning said lower stage assembly.

10. A blower assembly for a vacuum cleaner adapted to be driven by a motor comprising:

a noise reduction stage housing, including a plate having vanes on both faces, forming a radially outer gap and defining a serpentine flow path for air entering said blower assembly such that at substantially all times substantially the entire flow passes through said serpentine flow path;

baffle means positioned within and secured to said noise reduction stage housing for reducing noise of suction air entering said stage housing and enabling the air to pass into said stage housing, first and second fan assemblies rotatably driven by said motor for drawing air through said blower assembly, a fixed lower stage assembly positioned between said first and second fan assemblies for directing air from said first to said second fan assembly, a fixed upper stage assembly for directing air discharged from said second fan assembly to a central airflow hole, and a motor base having air flow directing vanes which receives air passing through said fixed upper stage assembly central airflow hole, said motor base and said noise reduction stage housing each acting to attenuate noise generated by the rotation of said first and second fan assemblies.

* * * * *